United States Patent [19]

Deng

[11] Patent Number: 4,778,967

[45] Date of Patent: Oct. 18, 1988

[54] ILLUMINATED SWITCH

[76] Inventor: Ching L. Deng, No. 2, Lane 488, Sec. 2, Chin Ling Rd., Ping Chen Hsiang, Tao Yuan, Taiwan

[21] Appl. No.: 69,186

[22] Filed: Oct. 14, 1986

Related U.S. Application Data

[63] Continuation of Ser. No. 736,023, May 20, 1985, abandoned.

[51] Int. Cl.[4] ..... H01H 9/00

[52] U.S. Cl. ..... 200/315; 200/311; 200/292; 250/214 AL; 315/134; 315/362

[58] Field of Search ..... 200/310–315, 200/317, 292; 250/214 AL; 315/158, 362, 134

[56] References Cited

U.S. PATENT DOCUMENTS

| | | | |
|---|---|---|---|
| 1,221,590 | 4/1917 | Rado | 315/138 |
| 1,931,310 | 10/1933 | Wegner | 200/317 |
| 3,541,504 | 11/1970 | Bush | 315/134 |
| 4,293,753 | 10/1981 | Kanada | 200/315 |
| 4,383,155 | 5/1983 | Tenner | 200/292 |
| 4,514,789 | 4/1985 | Jester | 200/310 |

*Primary Examiner*—Henry J. Recla
*Assistant Examiner*—Linda J. Sholl
*Attorney, Agent, or Firm*—Armstrong, Nikaido, Marmelstein & Kubovcik

[57] ABSTRACT

The present invention relates to an illuminated switch and in particular to one having a housing, switch contacts in the housing, an electrical device disposed in the housing and operatively associated with the switch contacts, a light transmissive colored filter mounted over a neon lamp of the electrical device, and a transparent member located over a cds photoresistor of the electrical device, whereby the neon lamp will light to provide indication of the switch location in darkness and will be extinguished when the switch is turned on.

1 Claim, 6 Drawing Sheets

ILLUMINATED SWITCH

This application is a continuation of application Ser. No. 736,023, filed May 20, 1985, now abandoned.

BACKGROUND OF THE INVENTION

This invention relates to an illuminated switch wherein the button thereof is illuminated in a particular color to provide indication of the switch location in darkness.

It has long been hoped to have a switch which can provide indication of the switch location in darkness. Accordingly, many illuminated switches have been developed. However, they are complicated in construction and comparatively expensive in manufacture.

It is therefore, an object of the present invention to provide an illuminated switch which may obviate and mitigate the above-mentioned drawbacks.

SUMMARY

It is the primary object of the present invention to provide an illuminated switch wherein the button thereof is illuminated in a particular color to show the location of the switch in darkness.

It is another object of the present invention to provide an illuminated switch which is simple in construction.

It is still another object of the present invention to provide an illuminated switch which is inexpensive to manufacture.

It is still another object of the present invention to provide an illuminated device which is convenient to use.

It is a further object of the present invention to provide an illuminated switch which consumes a small quantity of electric power.

It is still a further object of the present invention to provide an illuminated switch which is safe.

Other objects and merits and a fuller understanding of the present invention will be obtained by those having ordinary skill in the art when the following detailed description contemplated for practicing the invention has been read in conjunction with the accompanying drawings wherein like numerals refer to like or similar parts and in which:

BRIEF DESCRIPTION OF THE DRAWINGS

FIG. 4 is a cross-sectional view showing that the illuminated switch is turned on;

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
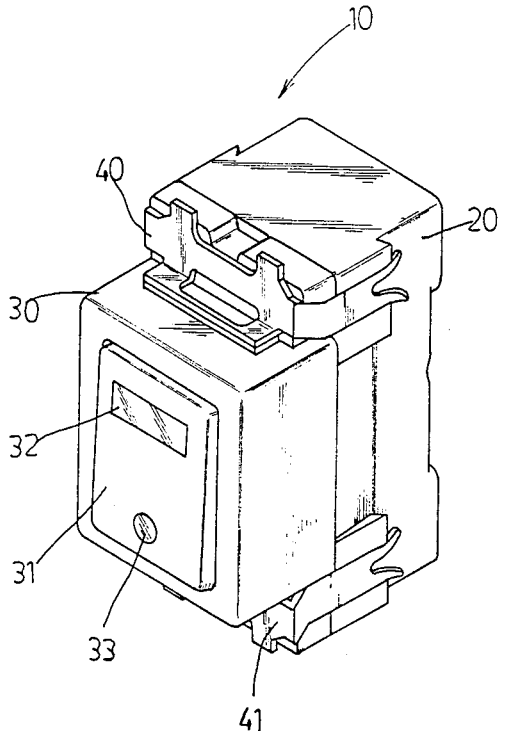
FIG. 1 is a perspective view of an illuminated switch according to the present invention.
Figure 2:
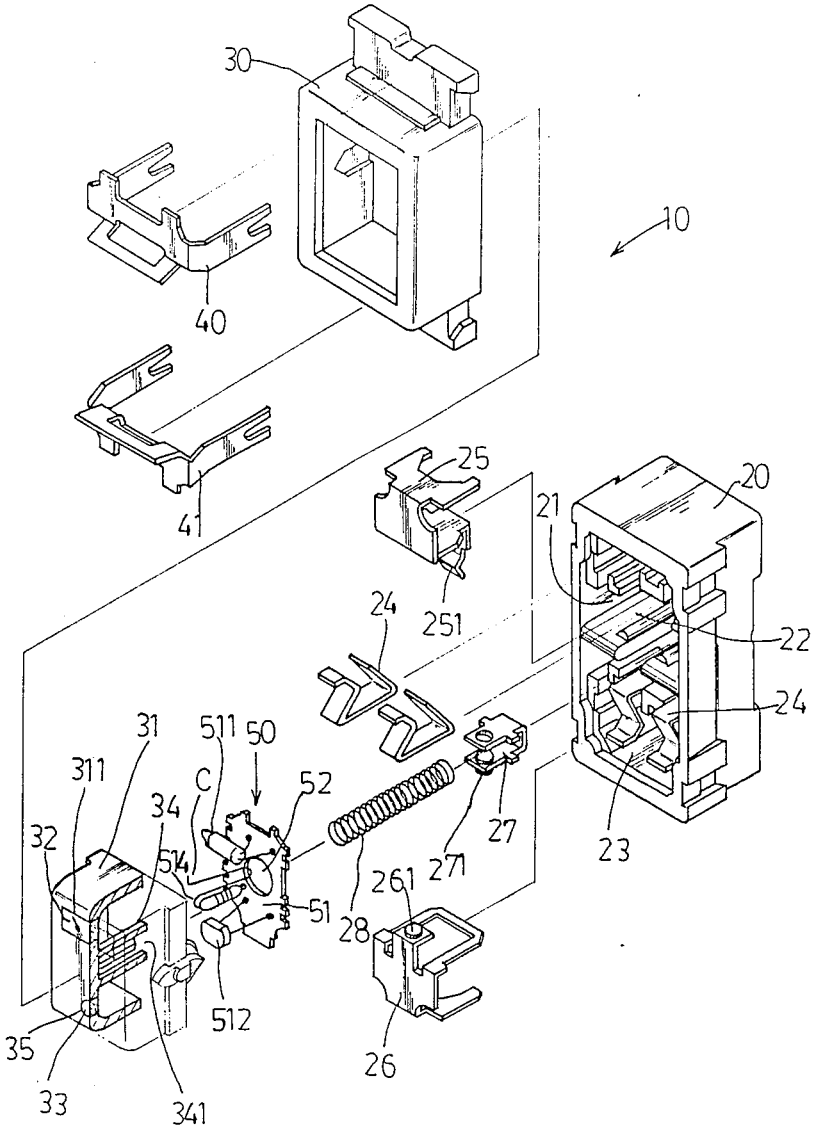
FIG. 2 is an exploded view of the illuminated switch.

Referring now to the drawings and in particular to FIGS. 1 and 2 thereof, the illuminated switch 10 according to the present invention comprises a rear body 20 and a cover 30. The rear body 20 which is well known in the art has a cavity 21 divided in two compartments 22 and 23, two pairs of terminals 24 respectively mounted in the two compartments 22 and 23, an upper fixing member 25 disposed in the upper compartment 22 for fixing a pair of terminals 24 in place, a lower fixing member 26 disposed in the lower compartment 23 to fix the other pair of terminals 24 in place, and a U-shaped rocking contactor 27 mounted at the center of the rear body 20. The upper fixing member 25 has a leg 251 extending to the center of the rear body 20. The lower fixing member 26 has a protuberance 261 on its top. The rocking contactor 27 is formed at the bottom thereof with a protuberance 271 adapted to the protuberance 261 of the lower fixing member 26. A helical spring 28 is disposed in the U-shaped rocking contactor 27.

The cover 30 is adapted to engage with the rear body 20 so as to fix a button 31 in position. Then, the cover 30 and the rear body 20 are connected together by two clamping members 40 and 41. The button 31 is provided in the front with a rectangular opening 311 embedded with light transmissive colored filter means 32 or the like and a hole 35 embedded with a transparent member 33. Further, the button 31 is formed with a cylindrical portion 34 extending from the rear surface thereof. The cylindrical portion 34 has a center hole 341 for receiving part of the helical spring 28. An electrical device 50 mounted on a printed circuit board 51 is secured to the cover 30, with the cylindrical portion 34 of the button 31 going through hole 52 of the printed circuit board 51.

Figure 5:
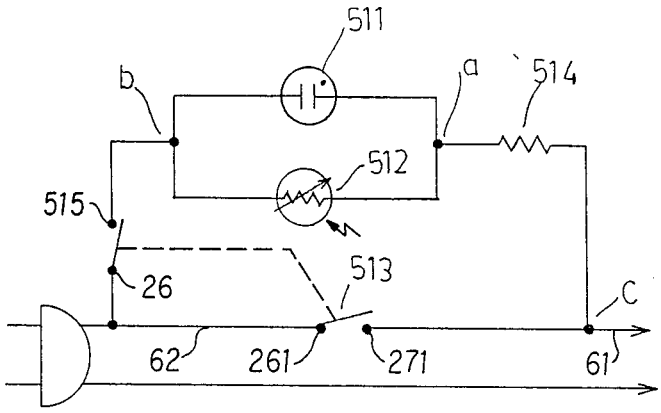
FIG. 5 shows the electrical circuit of the electrical device of the illuminated switch.

With reference to FIG. 5 there is shown the circuit of the electrical device. As can be seen, the electrical device 50 comprises a CdS photoresistor 512 connected in parallel with a neon lamp 511, forming two junctions a and b. The junction a is connected with a resistor 514. A switch 513 connected in series with the electrical source is connected across junctions b and c. The design of the printed circuit board 51 is shown in FIG. 6.

Figure 3:
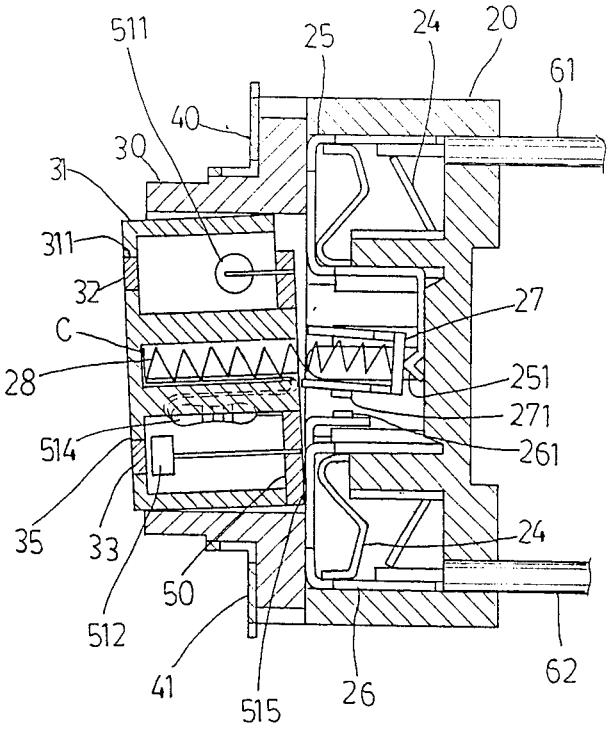
FIG. 3 is a cross-sectional view showing that the illuminated switch is turned off.
Figure 4:
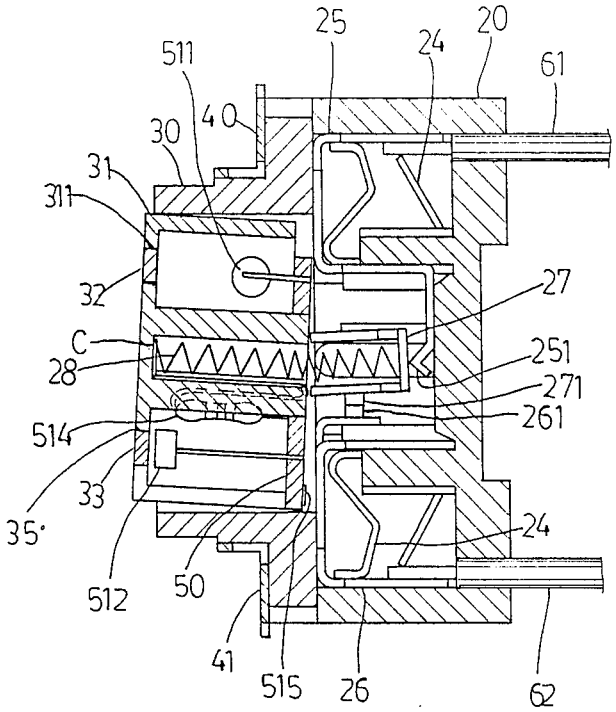
Figure 6:
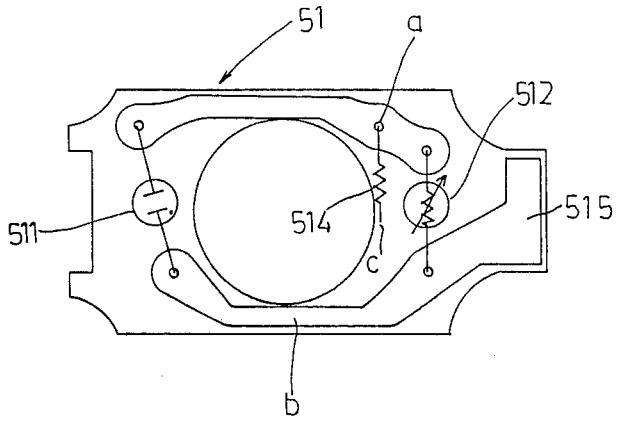
FIG. 6 shows the bottom of the printed circuit board of the electrical device of the illuminated switch.

As shown in FIGS. 3, 4 and 6, leg c of the resistor 514 is located in hole 341 of the cylindrical portion 34 of the button 31 and in contact with the helical spring 28. The helical spring 8 is always connected with the electrical source via a wire 61. Accordingly, the circuit of the electrical device shown in FIG. 5 will be closed when the contact terminal 515 of the printed circuit board 51 is in contact with the lower fixing member 26 which is always connected to the electrical source through wire 62.

In the event that the cds photoresistor 512 is illuminated by intense light, the internal resistance of the CDS 512 will become very small. Therefore, the potential difference across the cds photoresistor 512 is very small and the neon lamp 511 is extinguished. In darkness, the internal resistance of the photoresistor 512 is very high and so the potential difference thereacross will be much increased thereby causing the neon lamp 511 to light. The resistor 514 is used to limit the current passing therethrough.

The printed circuit board 51 is designed so that the neon lamp 511 and the photoresistor 512 are respectively aligned with the light transmissive colored filter means 32 and the hole 33.

With reference to FIG. 3, the illuminated switch 10 is turned off so that the circuit connecting the switch 10 and the lamp not shown is open. Meanwhile, the contact terminal 515 (shown in FIG. 6) of the printed circuit board 51 will get in touch with the lower fixing member 26 consequently closing the circuit of the electrical device 50. When in darkness, the internal resistance of the photoresistor 512 is very high thereby causing the neon lamp 511 to give light and therefore, indicating where the switch 10 is located. When in brightness, the internal resistance of the photoresistor 512 is very low and so the potential difference across the neon lamp 511 is not high enough to cause it to light.

With reference to FIG. 4, the illuminated switch is shown turned on.

Meanwhile, the contact terminal 515 of the printed circuit board 51 does not get in touch the lower fixing member 26 and so the circuit of the electrical device 50 is open. Hence only when the switch 10 is turned off and in darkness, the neon lamp 511 of the electrical device 50 will light to show the position of the switch 10. As the switch 10 is turned on, the neon lamp 511 will be automatically extinguished thereby saving electric power.

Although this invention has been described with a certain degree of particularly, it is understood that the present disclosure is made by way of example only and that numerous changes in the detail of construction and the combination and arrangement of parts may be resorted to without departing from the spirit and scope of the invention as hereinafter claimed.

I claim:

1. An illuminated switch, comprising:

a housing including a light-transmissive colored filter and a transparent member mounted therein; and an electrical device contained in said housing and including:

a primary switch connected at one end by a first terminal and at another end thereof by a second terminal, said first and second terminals mounted in said housing;

a neon lamp circuit comprised of a neon lamp and a photoresistor connected in parallel with each other and in series with a resistor, said neon lamp and photoresistor being operatively connected to said first terminal at a point opposite said resistor, and said resistor being connected to said second terminal at a point opposite said neon lamp and photoresistor, said neon lamp circuit thus being connected in parallel with said primary switch, said photoresistor having a high internal resistance in darkness and a low internal resistance when illuminated by intense light, said photoresistor and said neon lamp being disposed respectively under said transparent member and light transmissive colored filter of said housing;

a secondary switch interposed between said first terminal and said neon lamp and photoresistor;

a button for operating said primary switch, and wherein said neon lamp circuit is disposed within said button, wherein said primary switch includes a U-shaped rocking contact, actuated by said button, wherein said U-shaped rocking contact is always in contact with said second terminal such that when it is actuated by said button to be closed, said U-shaped rocking contact also contacts said first terminal, wherein said neon lamp circuit is mounted on a printed circuit board disposed within said button; and a helical spring attached at one end to said button, and electrically connected at another end thereof to said U-shaped rocking contact, such that said helical spring actuates said U-shaped rocking contact in response to the movement of said button, wherein said secondary switch includes a secondary contact terminal disposed on said printed circuit board and electrically connected to said neon lamp and photoresistor at a point opposite said resistor, said secondary contact terminal being engageable with said first terminal, such that when said primary switch is closed, said secondary contact terminal does not contact said first terminal and therefore power is not applied to said neon lamp circuit and such that when said primary switch is opened, said secondary contact terminal contacts said first terminal to apply power to said neon lamp circuit, and wherein said resistor is electrically connected to said second terminal by way of said helical spring, whereby when said primary switch is opened and said photoresistor is in darkness a voltage across said photoresistor will be sufficient to cause said neon lamp to light, and when said photoresistor is illuminated by intense light then a voltage across said photoresistor will be insufficient to light said neon lamp.

* * * * *

UNITED STATES PATENT AND TRADEMARK OFFICE

CERTIFICATE OF CORRECTION

PATENT NO. : 4,778,967

DATED : October 18, 1988

INVENTOR(S) : Ching L. DENG

It is certified that error appears in the above-identified patent and that said Letters Patent is hereby corrected as shown below:

On the cover page, Item [21], "69,186" should read --918,649--.

Signed and Sealed this

Second Day of May, 1989

*Attest:*

DONALD J. QUIGG

*Attesting Officer*

*Commissioner of Patents and Trademarks*